United States Patent [19]

Kerwin

[11] 4,239,570

[45] Dec. 16, 1980

[54] METHOD AND MACHINE FOR TRANSFERRING INDICIA TO TAPERED ARTICLES

[75] Inventor: Daniel Kerwin, Lombard, Ill.

[73] Assignee: The Meyercord Co., Carol Stream, Ill.

[21] Appl. No.: 949,527

[22] Filed: Oct. 10, 1978

[51] Int. Cl.[3] ..... B65C 3/16

[52] U.S. Cl. ..... 156/163; 156/238; 156/361; 156/363; 156/449; 156/475; 156/542; 156/DIG. 13; 156/DIG. 26; 156/DIG. 27; 156/DIG. 33; 198/344

[58] Field of Search ..... 156/541, 542, 447, 448, 156/449, 455, 458, 475, 160, 163, 361, 362, 363, 566, DIG. 12, DIG. 13, DIG. 27, DIG. 33, DIG. 41, DIG. 46, DIG. 42, DIG. 25, DIG. 26, 84–86, 229, 238, 446, 229; 198/334, 345, 411, 627, 416; 101/37, DIG. 3, DIG. 16, 39; 221/73, 40

[56] References Cited

U.S. PATENT DOCUMENTS

| | | | |
|---|---|---|---|
| 3,159,522 | 12/1964 | Schmidt | 156/557 |
| 3,235,433 | 2/1966 | Cvacho et al. | 156/229 |
| 3,313,667 | 4/1967 | Flood | 156/542 |
| 3,536,560 | 10/1970 | Vita et al. | 156/455 |
| 3,562,072 | 2/1971 | Stellamanns et al. | 156/566 |
| 3,928,115 | 12/1975 | Kerwin | 156/542 |
| 4,047,479 | 9/1977 | McKay | 101/DIG. 3 |

*Primary Examiner*—Michael W. Ball

*Attorney, Agent, or Firm*—Merriam, Marshall & Bicknell

[57] ABSTRACT

This disclosure deals with a machine for transferring indicia (such as decalcomanias) from an elongated web or carrier strip to tapered articles, such as tumblers, at a high rate of speed. The articles are moved along a transport path and means is provided to turn the articles as the articles are moved through an indicia transferring portion of the path. The web and the articles are moved in the same direction and in a generally straight line, and the articles are rolled across the web and the indicium, thereby peeling the indicium from the web. Means is provided to tilt the axes of the tapered tumblers relative to the plane of the web in order to place the side of the tumbler, which engages the web, parallel to the web. Hold down means is provided to force the tumblers to move in a straight line while rolling. Decals formed with an initial compensating distortion are used in the machine, to compensate for the distortion of the decals that occurs as the decals are transferred to the tumblers. Means is provided to control the registration of the decals and the tumblers, and means is provided to reduce the tendency of the web to have a different speed than the drive.

7 Claims, 7 Drawing Figures

15
110
114
PHOTO CELLS
132
131
133
MULTIPLIER
134
COUNTER
142
COUNT COMPARATOR
143
SERVO MOTOR CONTROL
141
COUNTER
139
MULTIPLIER
49
36
137
51
12
136
17

METHOD AND MACHINE FOR TRANSFERRING INDICIA TO TAPERED ARTICLES

U.S. Pat. No. 3,928,115 of Daniel Kerwin, issued Dec. 23, 1975 and entitled "Machine for Transferring Indicia to Cylindrical Articles", discloses a machine for transferring indicia from an elongated web to cylindrical articles such as beer bottles. Generally, the machine operates by rolling the articles along the length of the web and applying pressure between the web and the articles. Each article is rolled across an indicium, causing the indicium to be transferred from the web to the article. A machine of the character described in the foregoing patent No. 3,928,115 works well but its use is confined to generally cylindrical articles.

The following listed prior art U.S. patents disclose machines somewhat related to the machine of the present invention: Pat. Nos. 2,873,040, No. 3,012,650, No. 3,313,667, No. 3,139,368, No. 3,562,072, No. 3,483,063, No. 3,208,897, No. 3,159,522, and No. 3,111,446.

It is a general object of the present invention to provide an improved machine which will apply decals to tapered articles at a relatively high rate.

Apparatus in accordance with the present invention comprises means for moving a long web in a straight line through a transfer section, the web including a plurality of indicia located at regularly spaced intervals. Means is provided for moving a series of spaced articles in a straight line through the transfer section, the articles being pressed against the web. The articles are rolled along the web in the transfer section in order to peel the indicia from the web. The articles, for example tumblers, have tapered or slanted sides; in other words, they have the shape of a truncated cone. The apparatus further includes means for tipping or tilting the articles in the transfer section, and hold-down means for forcing the articles to move in the straight line. This forced movement causes slippage of the articles on the web and application distortion of the indicia, which are initially formed with a correcting distortion that compensates for the application distortion. Correct registration between the indicia and the articles is obtained by sensing and controlling the speeds of the articles and the indicia entering the transfer section.

The foregoing and other objects and advantages of the present invention will be better understood from the following detailed description taken in conjunction with the accompanying figures of the drawings, wherein.

Figure 1:
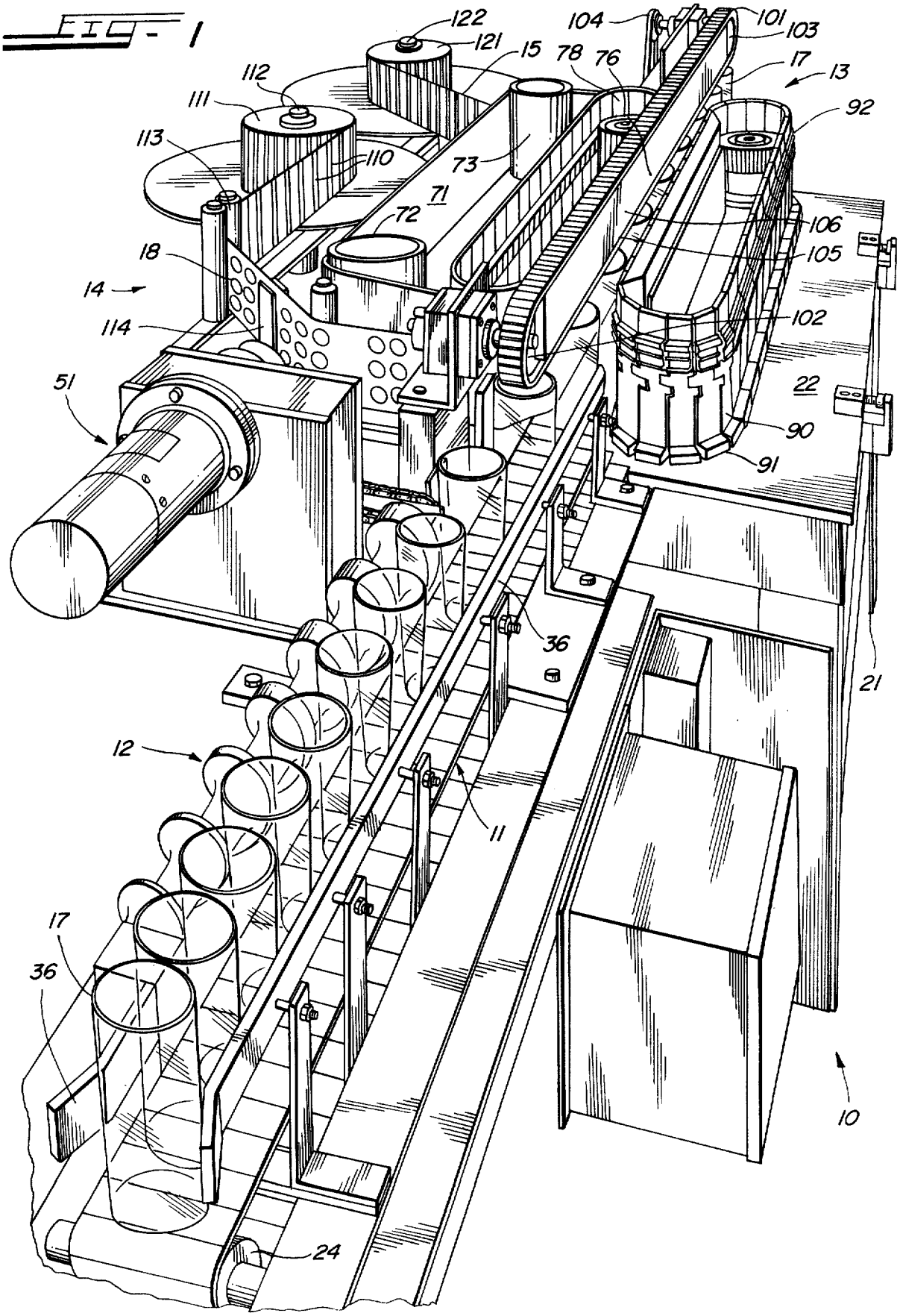
FIG. 1 is a perspective view of one side of a machine embodying the invention.
Figure 2:
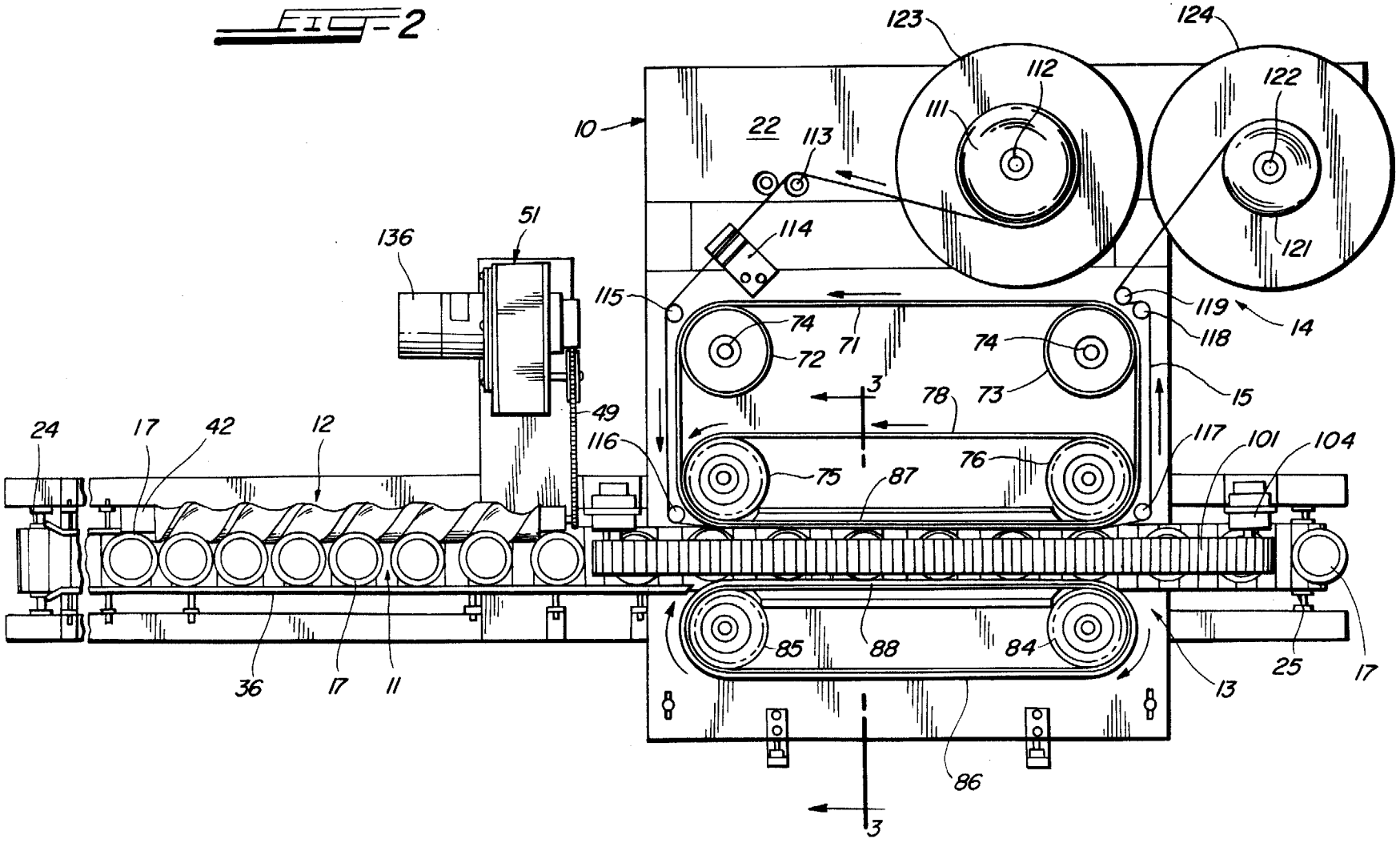
FIG. 2 is a plan view of the machine.
Figure 6:
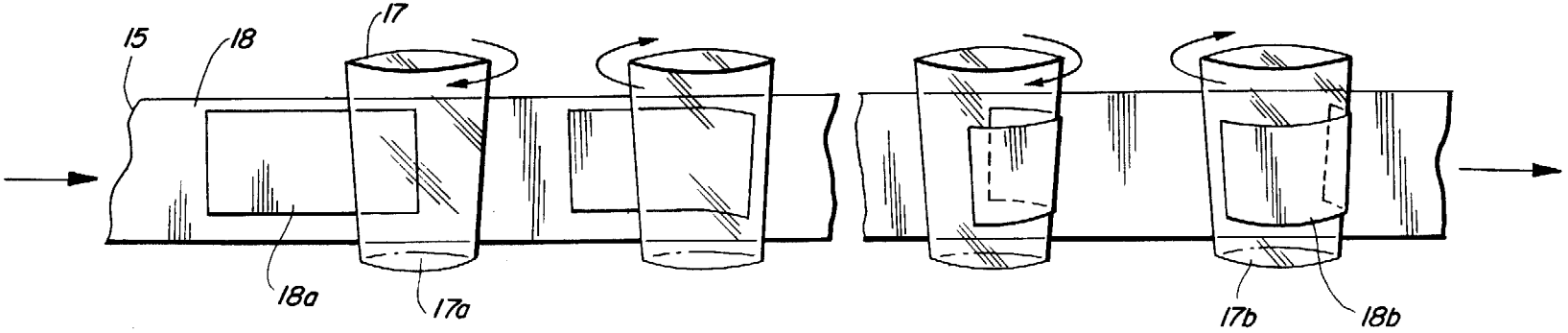
FIG. 6 is a diagrammatic view illustrating the operation of the apparatus.

With particular reference to FIGS. 1 and 2, a machine is illustrated comprising a frame 10 which supports the operative parts of the machine, an article transport path 11, a spacer 12 which spaces the articles moving along the path 11, a transfer section 13 for transferring indicia to articles moving on the transfer path 11, and a web transport path 14 for moving a web 15 through the transfer section. Articles moving along the path 11 are indicated by the reference numeral 17, and indicia on the web 15 are indicated by the reference numeral 18 (FIG. 6).

Figure 3:
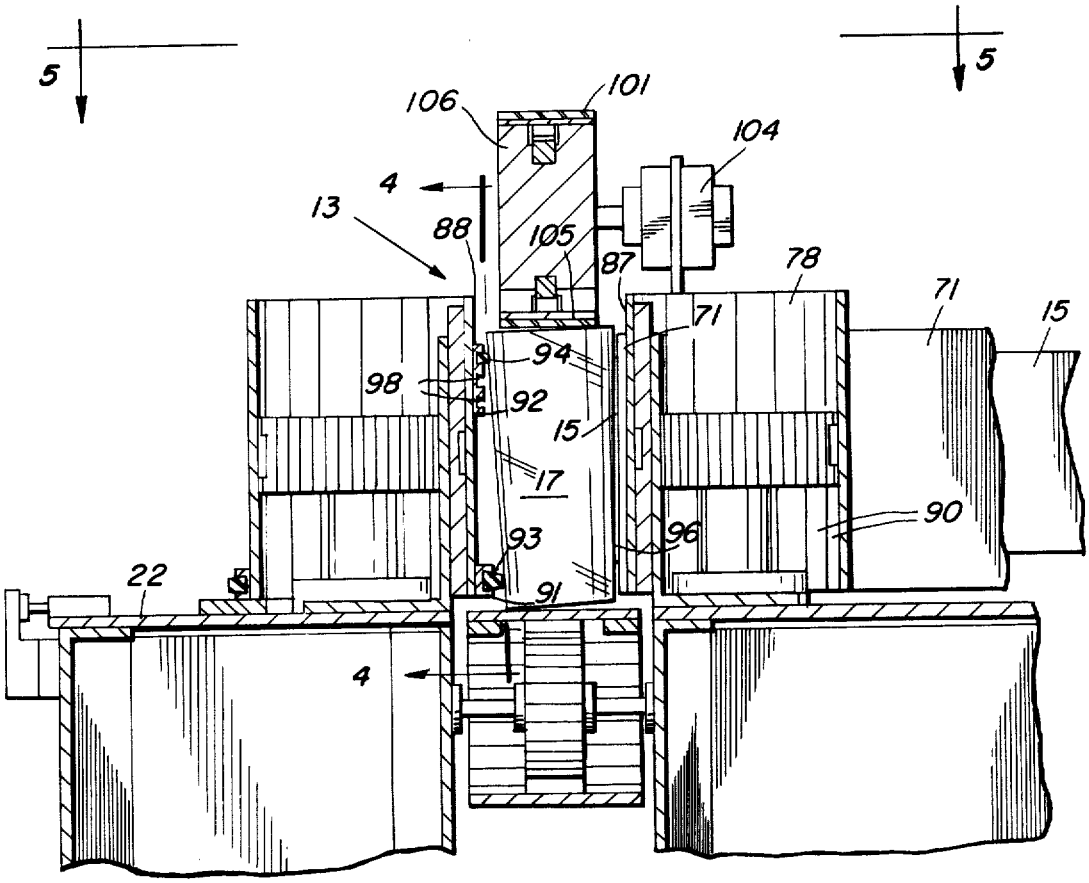
FIG. 3 is an enlarged fragmentary sectional view taken on the line 3—3 of FIG. 2.

While various types of indicia may be used, heat release decals are illustrated and described herein as a specific example. The articles have tapered or slanted sides and may, for example, comprise tumblers, as is best shown in FIGS. 3 and 6. The tumblers are placed in the machine with the open end facing upwardly regardless of the direction of the taper. Of course, the machine may also be used to apply decals to tapered articles other than tumblers.

The frame 10 of the machine is conventional in construction and may be built of structural steel members which form a plurality of legs 21 and a substantially flat horizontally disposed upper framework 22. The article transport path 11 consists, in the present instance, of a flexible continuous belt which extends lengthwise of the machine and is trained around rollers 24 and 25 mounted at opposite ends of the machine. Vertically extending guides 36 (FIG. 1) are preferably provided at the sides of the belt 11 to hold the tumblers 17 on the upper surface of the belt 11 and form a line of the tumblers at the inlet end of the machine. One of the two rollers 24 and 25 is driven in the direction to move the tumblers from left to right as seen in FIG. 2, so that tumblers placed on the inlet end of the belt 11, which is the end adjacent the roller 24, are moved toward the other roller 25. The drive mechanism for turning the belt 11 may be as described in patent No. 3,928,115.

As previously mentioned, the tumblers 17 are introduced onto the end of the belt 11 which is adjacent the roller 24. The tumblers are received from any suitable supply (not shown), and the tumblers are preferably received sufficiently fast to form a continuous lineup of tumblers at the inlet end of the machine. In the present example, as previously mentioned, the indicia on the web 15 are heat-release decals, and consequently the tumbler supply should include means, such as a lehr, for heating the tumblers 17 prior to the time they are placed on the belt 23.

The function of the spacer 12 is to space the tumblers 17 on the belt 11 prior to the time that the articles enter the transfer section 13, the spacing being related to the spacing of the decals 18 on the web 15, and to time the entrance of the tumblers to achieve proper registration with the decals. The spacer 12 comprises, in the present instance, a timing screw (FIGS. 3, 4 and 6) which is mounted on a shaft 42. The pitch of the timing screw 12 varies as shown in FIGS. 2 and 3, the pitch being relatively short at the entrance end of the screw and gradually lengthening toward the outlet end of the screw. At the entrance end of the screw 12, the pitch is substantially equal to the outer diameter of the tumblers being handled (FIG. 2), and at the outlet end of the screw 12, the pitch is somewhat less than the spacing between the decals 18. Since the screw pitch is less than the decal spacing, it is necessary to move the web faster than the tumblers to obtain proper registration. The screw 12 is positioned at one side of the belt 23 and the tumblers travel between the screw 12 and one of the guides 36. The tumblers 17 enter the screw 12 closely spaced as shown in FIG. 2 and, due to the increasing pitch of the screw 12, the spacing and the speed of the tumblers are gradually increased as the tumblers are moved toward the outlet end of the screw. After leaving the screw 12, the tumblers are carried by and move at the speed of the belt.

The screw 12 is rotatably driven by a chain 49 and an electric motor drive 51, and it will be apparent that a change in the drive speed will result in a change in the spacing of the tumblers 17 on the belt 11. The apparatus for controlling the drive speed will be described in more detail hereinafter.

The mechanism 13 for transferring the decals 18 from the web 15 to the tumblers 17 comprises a belt 71 (FIGS. 1, 2 and 5) which rotates in the counterclockwise direction as seen in FIG. 2, around two rollers 72 and 73 and a link chain 78. The rollers 72 are mounted on the frame 10 of the machine for rotation about vertical shafts 74. Two sprockets 75 and 76 have toothed outer surfaces, and the link chain 78 is trained around the two sprockets. The chain 78 consists of a plurality of links (FIGS. 1 and 3) which are connected together by clips. Both the belt 71 and the links 79 are vertically elongated and are approximately equal to the vertical height of the tumblers 17. The belt 71 is preferably made of a relatively thick compressible material preferably having an exterior coating of a material, such as silicone rubber, which will withstand the temperature of the heated tumblers 17.

The chain 78 is rotatably driven from main machine drive which is connected to one of the sprockets 75 or 76. Movement of the chain 78 also moves the belt 71 which is held in tight engagement with the chain 78.

The transfer section 13 includes the belt 71 and it further includes two sprockets 84 and 85 and a second link chain 86. The sprockets 84 and 85 are located on the opposite side of the belt 11 from the sprockets 75 and 76, and parallel sections 87 and 88 of the chains 78 and 86 extend adjacent opposite sides of the belt 11 and form a narrow channel therebetween.

Figure 4:
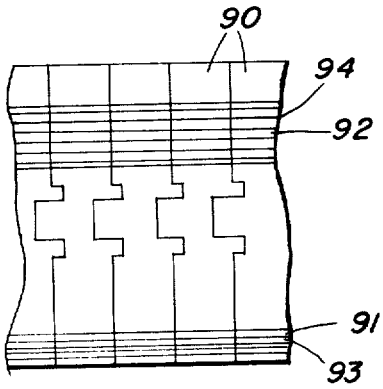
FIG. 4 is a fragmentary sectional view taken on the line 4—4 of FIG. 3.

The link chain 86 is also formed by a series of interconnected, vertically extending links 90 (FIGS. 1, 3 and 4). Adjacent the lower and upper ends of each link 90 are secured holders 91 and 92 which support spacers 93 and 94, respectively (FIGS. 3 and 4). The function of the spacers 93 and 94 is to tip or tilt the axis of the tumblers as shown in FIG. 3, as they pass through the channel between the chain 86 and the belt 71. The lower spacer 93 projects a greater distance toward the belt 71 than does the upper space 94, and the spacers 93 and 94 engage the tumblers adjacent the lower and upper ends. The sizes of the spacers are selected or designed for a particular tumbler size and tilt the tumblers and press the tumblers tightly against the web 15 which is drawn across the belt 71. The spacers are sized to tilt the axes of the tumblers to place the side 96 which is adjacent the belt 71, in a vertical plane and parallel to the plane of the belt 71.

The spacers 93 and 94 comprise resilient strips which are removably fastened in grooves formed in the holders 91 and 92. Since the spacers are removable, spacers may be selected and installed having sizes which are appropriate to the diameter of the tumblers to be processed. With reference to the upper holder 92, it is preferably provided with a plurality of vertically spaced grooves 98 so that different vertical heights above the belt 11 are available. Thus, tumblers having different vertical heights may be processed by the machine and the upper spacer 94 may be adjusted to a groove 98 which is adjacent the upper ends of the tumblers.

It will be apparent from FIG. 3 that the pressure against the opposite sides of the tumblers, by the belt 71 and the spacers 93 and 94, will tend to squeeze the tumblers 17 upwardly. Such upward movement is undesirable because it would reduce the amount of pressure of the tumblers against the web 15, and the decals would not be properly located on the tumblers. A hold-down mechanism is provided to prevent such upward movement, and comprises an endless belt 101 mounted above the tumblers 17 in the trough between the chain sections 87 and 88. The belt 101 is looped around two rollers 102 and 103, the roller 103 being driven by a chain and sprocket drive 104. The lower section 105 of the chain extends parallel to and engages the upper edges of the tumblers 17 in the trough, and the lower section 105 holds the tumblers on the belt 11. Thus, the two belts 11 and 101 confine the tumblers between them. The drive 104 is connected to the main drive of the machine and moves the belt 101 at the same rate as the lower belt 11. A support 106 is preferably provided between the upper and lower sections of the belt 101 in order to support them.

In the event the machine is used to apply decals to a tapered article which is loaded into the machine with its larger diameter on the conveyor belt 11, the belt 101 is unnecessary because the pressures on the tapered sides of the articles tends to move them downwardly, not upwardly.

While both sets of the sprockets 84, 85, 75 and 76 are driven by the main drive of the machine in order to turn the chains 78 and 86, the ratios of the respective drives are different so that the chain 78 moves at a slightly faster linear speed than the chain 86. Consequently, the tumblers roll or turn in the clockwise direction as viewed in FIG. 2, as they move from left to right. The angle or the amount of the turning movement of each tumbler is of course determined by the difference in the speeds of the chains 78 and 86, and in the present example, the speeds are adjusted to cause a tumbler to turn on its axis through an angle of approximately 430° as it passes through the channel between the chains 78 and 86. Further, the linear speeds of the chains 78 and 86 are substantially equal to the speed of the belts 11 and 101.

As previously mentioned, the web 15 is moved along a transport path by the web transport mechanism 14. With reference to FIGS. 1, 2 and 6, the web 15 comprises an elongated strip of a paper backing material which has the decals 18 on one side thereof at regularly spaced intervals. On the reverse or back side of the web 15 is formed a series of dark vertical lines or marks 110 (FIG. 1), the function of which will be described hereinafter. The web 15 is unreeled from a supply roll 111 mounted on a spindle 112, and threaded around an idler roller 113, past a photoelectric sensor 114, past two more idler rollers 115 and 116, across the section 87 of the belt 78, around additional idler rollers 117, 118 and 119, and to a takeup roll 121 mounted on another spindle 122. The takeup spindle 122 is turned by means (not shown) which exerts an almost constant tension on the web 15. If desired, a friction brake may be connected to the supply roll 111 to prevent it from turning too fast and introducing slack in the web 15. Large disks 123 and 124 are preferably provided under each roll 111 and 121 to support them.

The two idler rollers 116 and 117 serve the very important function of holding the web 15 away from the belt 71 in the areas where the belt 71 curves around the sprockets 75 and 76. In the machine disclosed in the previously mentioned Kerwin patent, the web is in tight engagement with the belt corresponding to the belt 71, in the two areas where the belt curves around the sprockets corresponding to the sprockets 75 and 76. The belt 71 is a relatively thick resilient member, and in the areas where the belt 71 curves around the sprockets 75 and 76, the outer surface of the belt 71 stretches. The outer surfaces of the stretched areas move at a faster surface speed than the surface speed of the belt 71 in the straight section 87 between the two sprockets 75 and 76. If the web 15 is permitted to engage the belt 71 in both the stretched areas and in the straight section 87, it is difficult to control the speed of the web because of the above mentioned differences in the surface speeds of the different sections of the belt 71. The belt 71 of course drives or moves the web 15 through the machine by virtue of the frictional engagement between the web and the belt and the fact that the web is squeezed between the belt 71 and the tumblers 17. The idler rollers 116 and 117 avoid the above difficulties by holding the web 15 spaced from the belt 71 in the curved areas. The rollers 116 and 117 are spaced from the belt 71 in opposite directions from the straight section 87 and they cause the web to engage the belt 71 only in the straight section 87.

Figure 5:
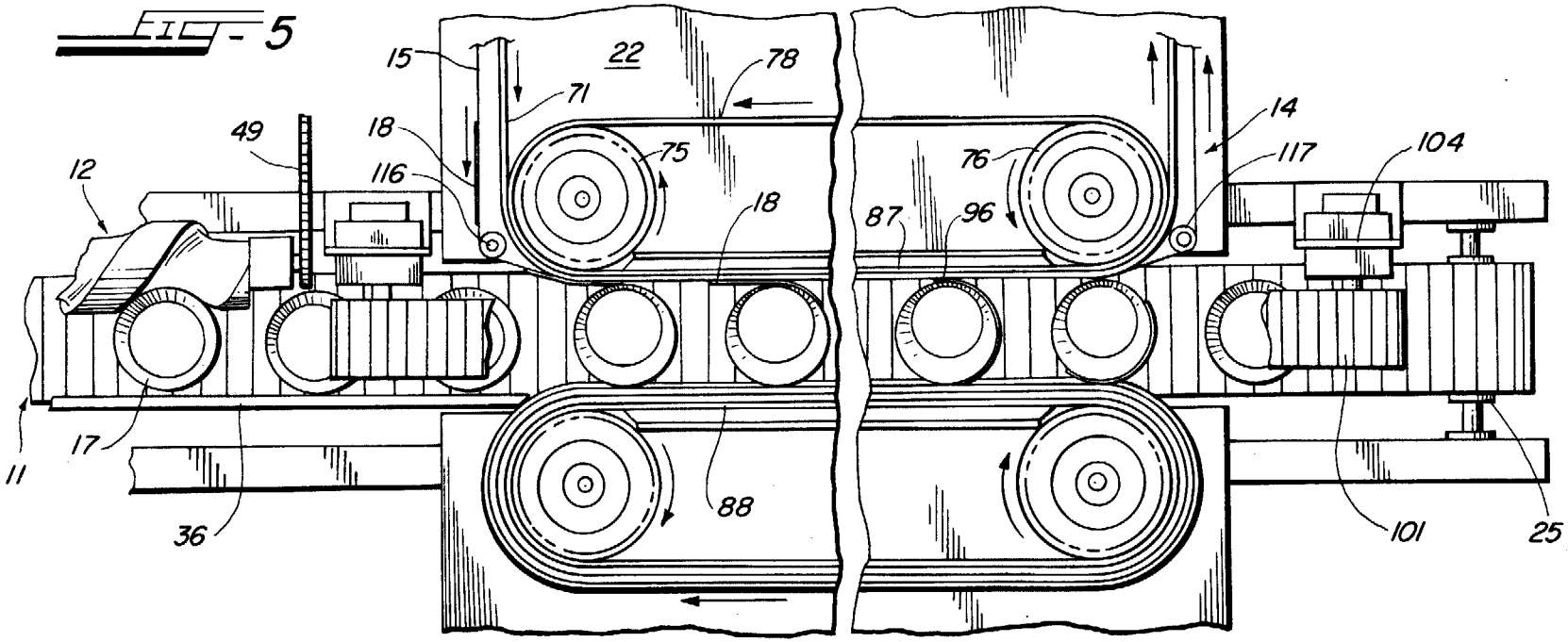
FIG. 5 is a top plan view taken on the line 5—5 of FIG. 3.

During operation of the machine, each tumbler 17 is located on the belt 23 to enter the trough between the chain sections 87 and 88 just ahead of the entrance of an associated decal 18. As shown in FIGS. 5 and 6, one of the tumblers, indicated by the numeral 17*a*, is rolling onto the leading edge of an associated decal 18*a*, and as the tumbler 17*a* advances through the transfer section, the tumbler 17*a* rotates through an angle of approximately 430°, and it rolls rearwardly across the associated decal 18*a*, causing the decal 18*a* to adhere to its outer surface. By the time the tumbler 17*a* has reached the outlet end of the trough, the decal has been completely peeled off from the web 15 and transferred to the tumbler, as shown by the tumbler 17*b* and the decal 18*b*.

If one were to roll a tapered article, such as a tumbler as shown in the drawings, along a flat surface, the article would normally roll on an arcuate path, the radius of the arc depending upon the difference between the large and the small diameters of the article. Each of the tumblers being processed in the present machine is likewise rolled along a flat surface which consists of the straight section 87 of the belt 71 and the length of the web 15 on it. However, the tumblers are not free to move in an arc because they are confined by the belts 11 and 101, and they are forced to roll in a straight line which parallels the web.

Because of this forced manner of movement, the upper and the lower end portions of each tumbler must slip or slide on the web 15 as it rolls. It follows therefore that the tumbler will also slip relative to the associated decal and distort it as the decal is being transferred. The portion of the decal which is transferred to the upper one-half of the tumbler will be stretched by this slippage, and the portion which is transferred to the lower one-half of the tumbler will be compressed. This is because the slippage causes the upper half of the tumbler to move faster than the decal and the lower half to move slower than the decal. At the center, the glass and the decal move at the same speed, except for the rolling movement of the tumbler across the decal.

The foregoing distortion during application is accommodated or compensated for by designing the decal with an initial compensating distortion. With reference to FIG. 6, each decal 18 is formed with the lower part of the design initially distorted by stretching it in the direction of the long dimension of the web 15 and with the upper part distorted by compressing it in this direction. Thus, the distortion that occurs during application is counter and equal to the initial distortion, and the end result is a true, undistorted representation of the design.

Figure 7:
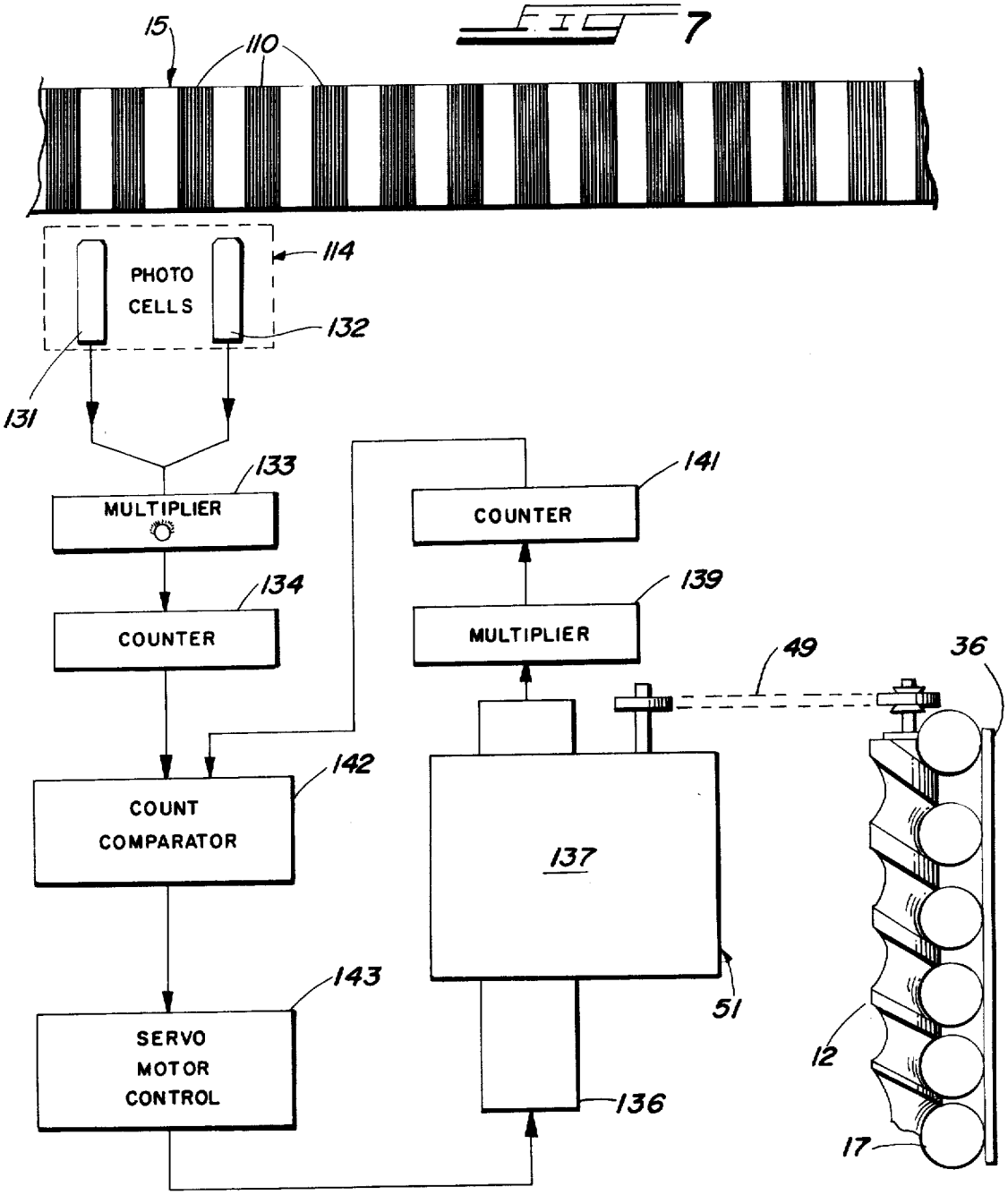
FIG. 7 is a schematic diagram of a control system of the apparatus.

A further feature of the present apparatus resides in the means for obtaining proper registration between the tumblers and the decals as they enter the trough of the decal applying section. With reference to FIG. 7, the photocell 114 includes at least one sensor. In the present instance it includes two sensors 131 and 132 for the purpose to be described later. Each of the sensors 131 and 132 generates a pulse each time a line 110 passes it, and the pulses of the two sensors are connected to the same input of a pulse multiplier 133. The web speed pulse frequency is multiplied by a factor of, for example, 800 and the signal is fed to the input of a counter 134.

The electric motor drive 51 for the timing screw 12 includes a servomotor 136 which is connected through a gear box 137 and the chain 49 to drive the screw 12. A pulse generator 138 is also driven by the gear box 137 and it generates a train of screw speed pulses having a frequency which is a function of the speed of the servomotor 136 and the screw 12. A suitable commercially available pulse generator is sold under the trademark Rotopulser. The screw speed pulse frequency is multiplied by a multiplier 139 and fed to a counter 141.

The outputs of the two counters 134 and 141 are fed to two inputs of a count comparator 142 which produces an output error signal that is a function of the count difference. The error signal actuates a servomotor control 143 which in turn controls the servomotor 136.

The control 143 is preferably adjusted to operate the motor 136 to turn the screw at a somewhat slower rate than the web 15. In other words, as previously mentioned, the web 15 is preferably moved faster than the tumblers, and the spacing between the tumblers entering the decal applying section is less than the distance between the center lines of the decals, and the control is adjusted to maintain this relation between the web and screw speeds.

The parts 133, 134, 139 and 141 to 143 may be standard commercially available electronic components. The photocell 114 preferably includes the two sensors 131 and 132, even though only one sensor would suffice, as a safeguard. The two sensors are spaced apart an integral number of the lines 110, such as five lines, and normally the two sensors simultaneously generate pulses. In the event one of the sensors fails or one of the lines 110 is blurred or missing, the other sensor will still generate a pulse at the proper time. The multiplier 133 is preferably made manually adjustable in order to accommodate different spacings between adjacent decals on the web 15. As a specific example, if a given length of the web 15 has two decals on one side and twenty marks 110 on the opposite side, the multiplier 133 is adjusted to provide 800 pulses per mark and the tumblers are spaced 7.714 inches apart; if the same length of web has four decals on it and twenty marks, the multiplier 133 is adjusted to provide 1600 pulses per mark and the tumbler spacing is 4.32 inches. The number of decals on a given length of the web of course depends on the sizes of the decal.

It will be apparent that a novel and useful machine and method of applying decals has been provided. Both the indicia and the tapered articles are moved at high speed along parallel linear paths, and the decals are applied while the articles are tipped to place them parallel to the decals. The tapered articles are thus forced to roll in a linear path while tipped. When the large end of the tapered articles are uppermost, a hold down belt holds the articles in the proper path, but when the large end is lowermost, the hold down is not necessary and the lower conveyor belt holds the articles in the path. The rollers 116 and 117 reduce slippage of the web on the belt 78, but the variable speed drive for the screw 12 corrects for any slippage. Even if slippage of the web or stretching of the web should occur proper correction will be made because the speed control senses the web speed directly. Instead of adjusting the timing screw speed, the web speed could of course be adjusted.

I claim:

1. The method of applying indicia to a series of articles, the indicia comprising a series of spaced decals on an elongated web, said method comprising the steps of moving a series of articles between spaced belt means, moving the indicia in spaced apart relation across one of the belt means and along a generally linear path, utilizing the other of the belt means to tip the articles to place a side of each article in a plane parallel to the indicia, the articles moving in a linear path parallel to the path of the indicia, and utilizing the belt means to roll the articles over the indicia during said movements and while said articles are tipped to produce slippage between the articles and the indicia.

2. A machine for applying indicia to a succession of tapered articles while the articles are in movement, the indicia being removably attached to an elongated web and being spaced on said web, said indicia comprising decals, said machine comprising an indicia transfer section including two spaced apart belt means, web transport means for moving the web through said section and across one of said belt means and the portion of the web extending across said belt means moving in a generally linear direction, article transport means for moving a series of spaced apart tapered articles through said section and closely adjacent said portion of the web, said belt means including means for tipping said articles as they move through said section to place the side of each tapered article which is adjacent the web in a plane which is parallel to the plane of said portion of the web, and said belt means pressing each of said articles against said portion of the web and rolling the article along said portion of the web and over an indicium as the article moves through the transfer section, whereby the web and the articles are moved in parallel linear paths while the articles are held in the tipped position as they roll over the indicia, said movement in parallel linear paths producing slippage between the surfaces of the articles and the decals.

3. A machine as in claim 2, wherein said means for pressing and rolling the articles comprises a moving belt which moves at a speed which is different from the speed of said portion of the web and thereby causes the articles to roll along the web.

4. A machine as in claim 2, wherein the plane of said portion of the web is substantially vertical, and the smaller diameter end of each article is at the bottom.

5. A machine as in claim 4, and further including hold-down means engaging the uppermost end of each of the articles in said section.

6. A machine for applying indicia to a succession of tapered articles while the articles are in movement, the indicia being removably attached to an elongated web and being spaced on said web, said machine comprising an indicia transfer section, web transport means for moving the web through said section and the portion of the web in the section moving in a generally linear direction, article transport means for moving a series of spaced apart tapered articles through said section and closely adjacent said portion of the web, means for tipping said articles as they move through said section to place the side of each tapered article which is adjacent the web in a plane which is parallel to the plane of said portion of the web, and means for pressing each of said articles against said portion of the web and rolling the article along the web and over an indicium as the article moves through the transfer section, whereby the web and the articles are moved in parallel linear paths while the articles are held in the tipped position as they roll over the indicia, said means for pressing and rolling the articles comprises a moving belt which moves at a speed which is different from the speed of said portion of the web and thereby causes the articles to roll along the web, and said tipping means comprising spacers fastened to said belt.

7. A machine for applying indicia to a succession of tapered articles while the articles are in movement, the indicia being removably attached to an elongated web and being sequentially spaced on said web, said machine comprising an indicia transfer section, web transport means for moving the web through said section and the portion of the web in the section moving in a generally linear direction, article transport means for moving a series of spaced apart tapered articles through said section and closely adjacent said portion of the web, said transfer section including belts on opposite sides of the section and movable at different speeds in order to roll each article along the belts, spacer means on one of the belts for tipping said articles as they move through said section to place the side of each tapered article which is adjacent the web in a plane which is parallel to the plane of said portion of the web, said belts pressing said articles against said portion of the web and rolling the articles along the web and over indicia as the articles move through the transfer section, the web and the articles being moved in parallel linear paths while the articles are held in the tipped position as they roll over the indicia, means spacing the articles on the transport means, and means responsive to the speed of the web and to the spacing of the articles for regulating said spacing.

* * * * *